US010938093B2

(12) United States Patent
Koay et al.

(10) Patent No.: US 10,938,093 B2
(45) Date of Patent: Mar. 2, 2021

(54) PORTABLE COMMUNICATION DEVICE AND ANTENNA DEVICE WITH ROBUST ROTATIONAL ATTACHMENT

(71) Applicant: MOTOROLA SOLUTIONS, INC., Chicago, IL (US)

(72) Inventors: Kenney Koay, Simpang Ampat (MY); Toymuan Yoong, Georgetown (MY); Alexander Oon, Bayan Lepas (MY); Weng Kong Hor, Butterworth (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/512,509

(22) Filed: Jul. 16, 2019

(65) Prior Publication Data

US 2021/0021016 A1 Jan. 21, 2021

(51) Int. Cl.

| | |
|---|---|
| ***H01Q 1/08*** | (2006.01) |
| ***H01Q 1/24*** | (2006.01) |
| ***H01Q 1/12*** | (2006.01) |
| ***H01Q 1/36*** | (2006.01) |

(52) U.S. Cl.

CPC ..... *H01Q 1/243* (2013.01); *H01Q 1/085* (2013.01); *H01Q 1/1207* (2013.01); *H01Q 1/36* (2013.01)

(58) Field of Classification Search

CPC ..... H01Q 1/08; H01Q 1/084; H01Q 1/085; H01Q 1/087; H01Q 1/088; H01Q 1/10; H01Q 1/103; H01Q 1/106; H01Q 1/12; H01Q 1/1207; H01Q 1/1235; H01Q 1/1242; H01Q 1/241; H01Q 1/242; H01Q 1/243; H01Q 1/244; H01Q 1/246; H01Q 1/273; H01Q 1/288; H01Q 1/32; H01Q 1/325; H01Q 1/3258; H01Q 1/3275; H01Q 1/3283; H01Q 1/3291; H01Q 1/34; H01Q 1/36; H01Q 1/362

See application file for complete search history.

(56) References Cited

U.S. PATENT DOCUMENTS

| | | | | |
|---|---|---|---|---|
| 8,206,176 | B2 | 6/2012 | Islam | |
| 2007/0205960 | A1 | 9/2007 | Fujikawa et al. | |
| 2010/0188303 | A1* | 7/2010 | Koh | H01Q 9/32 343/725 |
| 2014/0125552 | A1* | 5/2014 | Takisawa | H01Q 1/362 343/895 |
| 2015/0214607 | A1* | 7/2015 | Lee | H01Q 5/307 343/713 |
| 2020/0194867 | A1* | 6/2020 | Lee | H01Q 1/088 |

* cited by examiner

*Primary Examiner* — Seokjin Kim
(74) *Attorney, Agent, or Firm* — Perry + Currier, Inc.

(57) ABSTRACT

A portable communication device and antenna device with robust rotational attachment is provided. The antenna device comprises: a base, the base being electrically conducting; an insulating core extending from the base; a clip attached to the base, the clip being electrically conducting, the clip and the base configured to cooperate such that: the base frictionally retains the clip; and the clip at least partially rotates around the base while making electrical contact thereto; and an antenna element extending from the clip along the insulating core, the antenna element shaped to at least partially rotate around the insulating core as the clip rotates at least partially around the base.

21 Claims, 5 Drawing Sheets

PORTABLE COMMUNICATION DEVICE AND ANTENNA DEVICE WITH ROBUST ROTATIONAL ATTACHMENT

BACKGROUND OF THE INVENTION

Some portable communication devices include removeable antenna devices which may be removeable and/or attachable to a portable communication device via a twisting motion, which may place stress on electrical connections in the antenna device.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
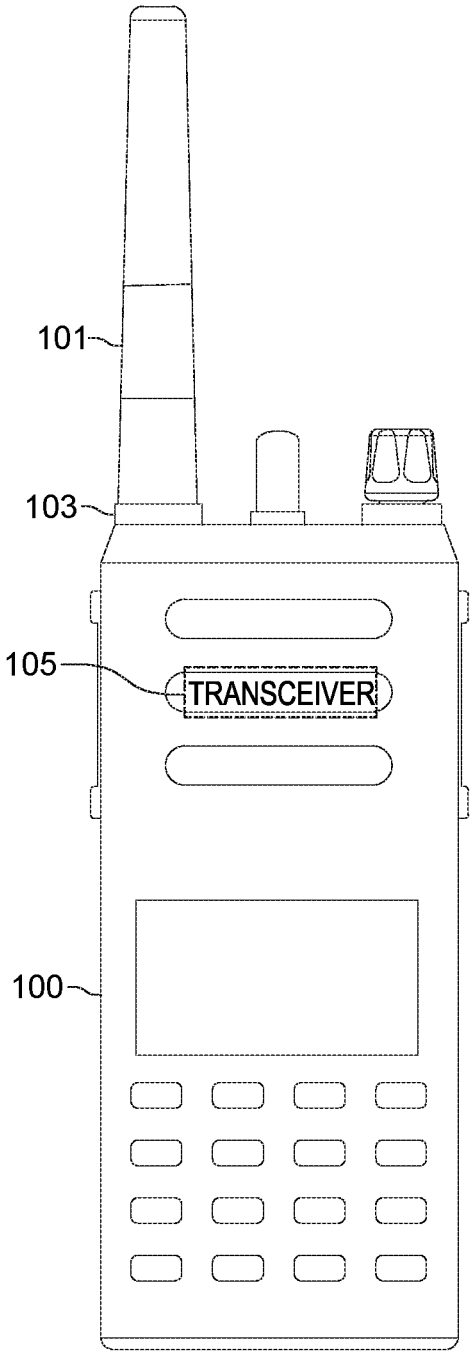
FIG. 1 depicts a portable communication device that includes an antenna device with a helical antenna element, in accordance with some examples.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Some portable communication devices include removeable antenna devices which may be removeable and/or attachable to a portable communication device via a twisting motion, which may place stress on electrical connections in the antenna device. For example, the antenna device may mate with an antenna receptable at a communication device via threads, and as a user turns the antenna device to tighten the threads, the torque on the antenna device may suddenly increase; similarly, when the antenna device is being removed from the communication device, a large sudden torque may be used to loosen the antenna device from the communication device. Either scenario may place rotational stress on electrical connections in the antenna device Hence, an aspect of the present specification provides an antenna device comprising: a base, the base being electrically conducting; an insulating core extending from the base; a clip attached to the base, the clip being electrically conducting, the clip and the base configured to cooperate such that: the base frictionally retains the clip; and the clip at least partially rotates around the base while making electrical contact thereto; and an antenna element extending from the clip along the insulating core, the antenna element shaped to at least partially rotate around the insulating core as the clip rotates at least partially around the base.

Another aspect of the present specification provides a portable communication device comprising: a transceiver; an antenna receptable; and antenna device comprising: a base, the base being electrically conducting, the base configured to removably attach to the antenna receptable; an insulating core extending from the base; a clip attached to the base, the clip being electrically conducting, the clip and the base configured to cooperate such that: the base frictionally retains the clip; and the clip at least partially rotates around the base while making electrical contact thereto; and an antenna element extending from the clip along the insulating core, the antenna element shaped to at least partially rotate around the base as the clip rotates at least partially around the base, the transceiver in communication with the antenna element via the antenna receptable and the base to wirelessly communicate via the antenna element.

In general, the clip holds the antenna element in place relative to the base, while also rotating relative to the base, allowing the antenna element to also rotate relative to the base, which may at least partially relieve rotational stress on the antenna element as the antenna device is attached to and/or removed from, the portable communication device.

Attention is directed to FIG. 1, which depicts a perspective view of an example communication device 100 comprising an antenna device 101, an antenna receptable 103, and a transceiver 105. The communication device 100 is interchangeably referred to hereafter as the device 100. The transceiver 105 is depicted in dotted lines indicating that the transceiver 105 is internal to the device 100.

As depicted, the device 100 comprises a portable communication device such as a land-mobile radio (LMR), for example used by first responders; however, the device 100 may comprise any suitable communication device configured to receive detachable antennas, including, but not limited to, push-to-talk (PTT) radios, citizens broadband radio service (CBRS) radios and the like. However, while the device 100 as depicted is a portable communication device, in other examples the device 100 may not be mobile and/or may be adapted for use in a vehicle.

The antenna device 101 is removably attachable to the device 100 via the antenna receptable 103 using, for example, a twisting motion to remove and attach the antenna device 101 to the antenna receptable 103. Hence, the antenna receptable 103 may alternatively be referred to as the corresponding receptacle 103 (e.g. a receptable corresponding to, and/or configured to receive, the antenna device 101). The transceiver 105 is generally in communication with an antenna element of the antenna device 101 via the antenna receptable 103 and a base of the antenna device 101 to wirelessly communicate via the antenna element. While not depicted, the antenna device 101 may be one of a plurality of antenna devices that are removably attachable to the device 100, each of the plurality of antenna devices configured to operate at different (or the same) frequency bands, including, but not limited to, a range of about 700 MHz to about 900 MHz, with the transceiver 105 adapted accordingly.

Indeed, the transceiver 105 may comprise one or more of a digital mobile radio (DMR) transceiver, a Project 25 (P25) transceiver, a terrestrial trunked radio (TETRA) transceiver, a Bluetooth transceiver, a Wi-Fi transceiver, for example operating in accordance with an IEEE 802.11 standard (e.g., 802.11a, 802.11b, 802.11g), an LTE (Long-Term Evolution) transceiver and/or other types of GSM (Global System for Mobile communications) transceivers, a Worldwide Interoperability for Microwave Access (WiMAX) transceiver, for example operating in accordance with an IEEE 802.16 standard, and/or another similar type of wireless transceiver configurable to communicate via a wireless radio network. While not depicted, the transceiver 105 may be generally controlled by a processor of the device 100 implementing instructions stored at a computer-readable medium of the device 100, for example to control a frequency range in which the transceiver 105 is to communicate, depending on a frequency range of an antenna device attached to the device 100.

Figure 2:
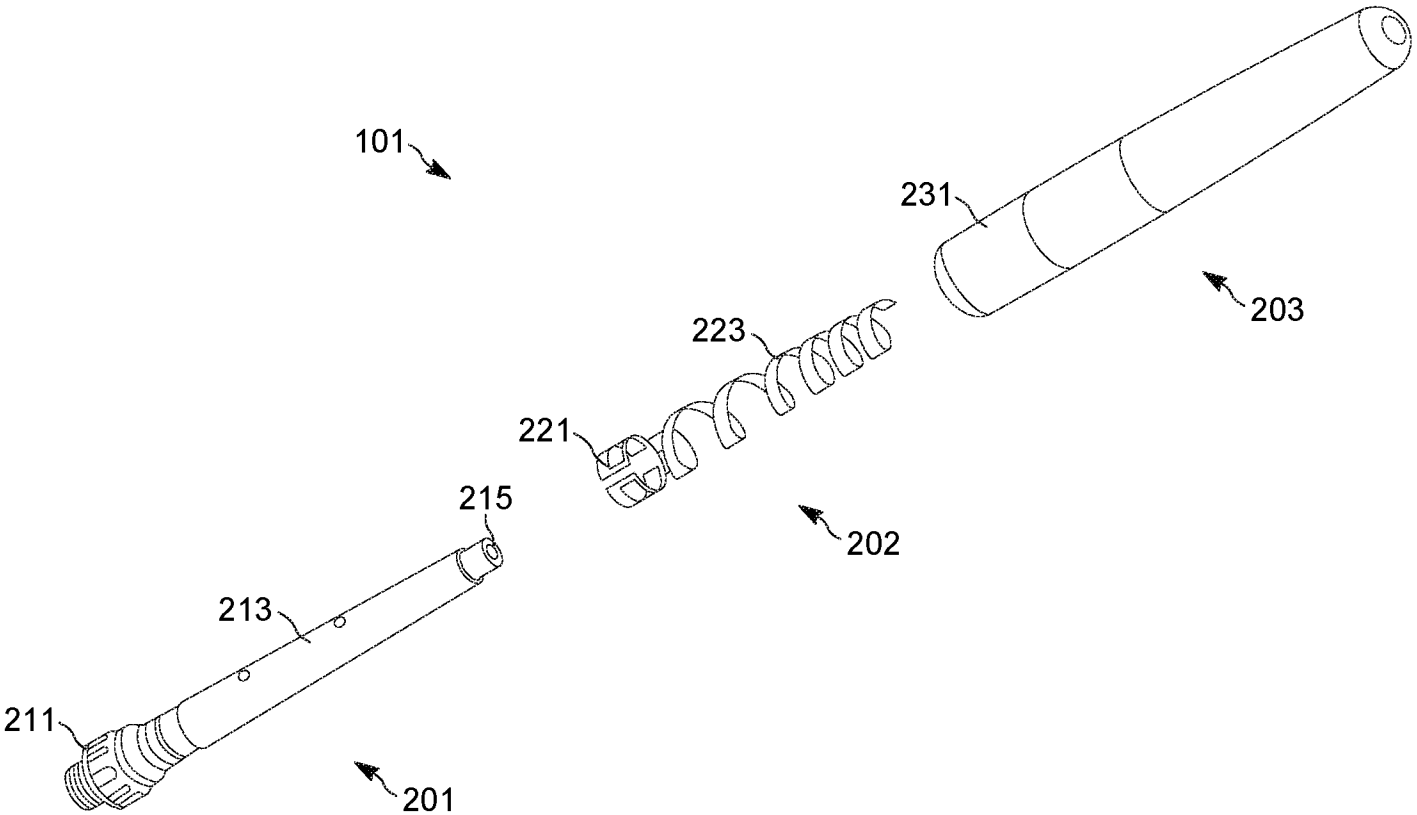
FIG. 2 is an exploded view of the antenna device of FIG. 1, in accordance with some examples.

Attention is next directed to FIG. 2 which depicts an exploded view of the antenna device 101. As depicted, the antenna device 101 comprises three units 201, 202, 203, which may be assembled into the antenna device 101. However, the antenna device 101 may be provided and/or assembled in any suitable configuration.

As depicted, the unit 201 comprises: a base 211, the base 211 being electrically conducting; and an insulating core 213 extending from the base 211. As depicted, the unit 202 further comprises an internal antenna element 215 element located inside the insulating core 213, the internal antenna element 215 electrically isolated from the base 211, but connectable to the transceiver 105 via an electrical connector (not visible in FIG. 2; for example see FIG. 5) configured to electrically connect the internal antenna element 215 to the transceiver 105 at the device 100 when the base 211 is removably attached to the corresponding antenna receptable 103 at the device 100.

As depicted, the unit 202 comprises a clip 221 attachable to the base 211, as described in more detail below, the clip 221 being electrically conducting, the clip 221 and the base 211 configured to cooperate such that: the base 211 frictionally retains the clip 221; and the clip 221 at least partially rotates around the base 211 while making electrical contact thereto.

As depicted, the unit 202 further comprises an antenna element 223 extending from the clip 221. As depicted, the unit 202 may be slipped over the insulating core 213 of the unit 201 to assemble the units 201, 202. In particular, the clip 221 may be configured to slide over the insulating core 213 to attach the clip 221 to the base 211. For example, during assembly, a biased retainer of the clip 221 may mate and/or clip into a complementary groove of the base 211 to frictionally retain the clip 221 at the base 211 such that, for example, the clip 221 does not slip off of the base 211. Such a configuration further allows the clip 221 to at least partially rotate around the base 211 while making while making electrical contact thereto. In general, the antenna element 223 is shaped to at least partially rotate around the insulating core 213 (e.g. along an outside surface of the insulating core 213) as the clip 221 rotates at least partially around the base. Hence, as depicted, the outside surface of the insulating core 213 is generally smooth facilitate rotation of the antenna element 223 at least partially rotate around the insulating core 213.

While the antenna element 223 is depicted as a helical antenna element, the antenna element 223 may comprise a straight-wire monopole and/or any suitable type of antenna element shaped to at least partially rotate around the insulating core 213 as the clip 221 rotates at least partially around the base. However, as depicted, the antenna element 223 may be helically wrapped around the insulating core 213 when the units 201, 202 are assembled.

The unit 203 generally comprises a sheath 231, for example an insulating housing, and the like. The unit 203 may be assembled with the units 201, 202 by slipping the sheath 231 over the assembled units 201, 202 to contain the clip 221, the insulating core 213, the antenna element 223, and at least a portion of the base 211 that retains the clip 221. In general, the sheath 231 further contains the internal antenna element 215 when the units 201, 202, 203 are assembled.

Furthermore, the sheath 231 does not interfere with the rotation of the clip 221 relative to the base 211, and/or rotation of the antenna element 223 relative to the insulating core 213. For example, when the units 201, 202, 203 are assembled, and the sheath 231 contains the clip 221, the insulating core 213, the antenna element 223, and at least a portion of the base 211 that retains the clip 221, the clip 221 remains at least partially rotatable around the base 211, while making electrical contact thereto, and the antenna element 223 remains least partially rotatable around the insulating core 213 as the clip 221 rotates at least partially around the base. Hence, the antenna device 101 may include a gap between an internal surface of the sheath 231 and the components contained therein to allow the rotation of the clip 221 and the antenna element 223.

Furthermore, the sheath 231 may comprise a hard insulating material, such as a hard plastic and the like, such that that when the sheath 231 is squeezed, for example during attachment and removal of the antenna device 101 to the device 100, the sheath 231 does not deform and interfere with rotation of the clip 221 and the antenna element 223.

Figure 3A:
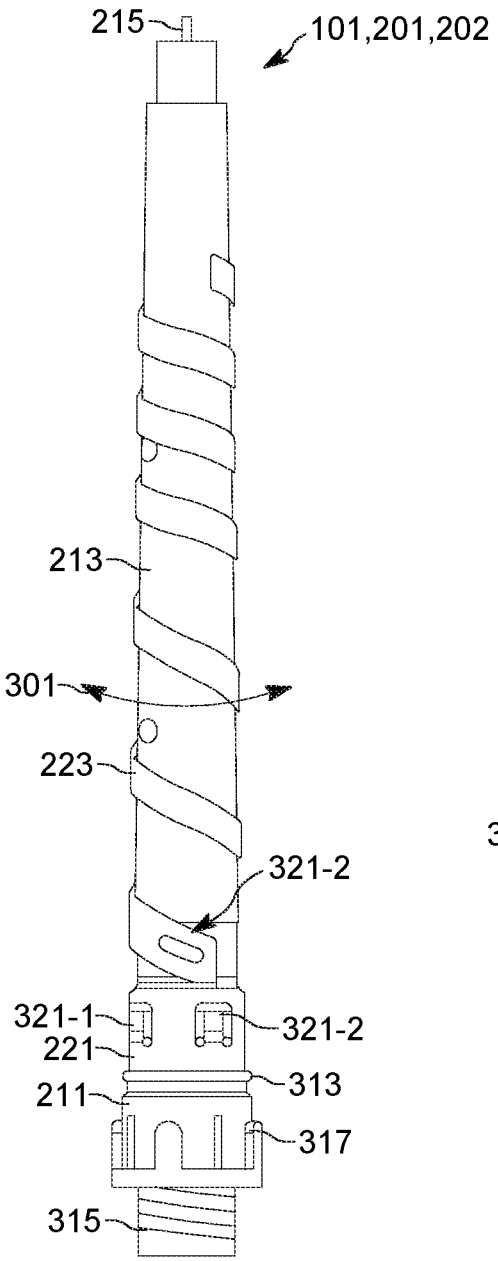
FIG. 3A is a side view of the antenna device with a sheath removed, in accordance with some examples.
Figure 3B:
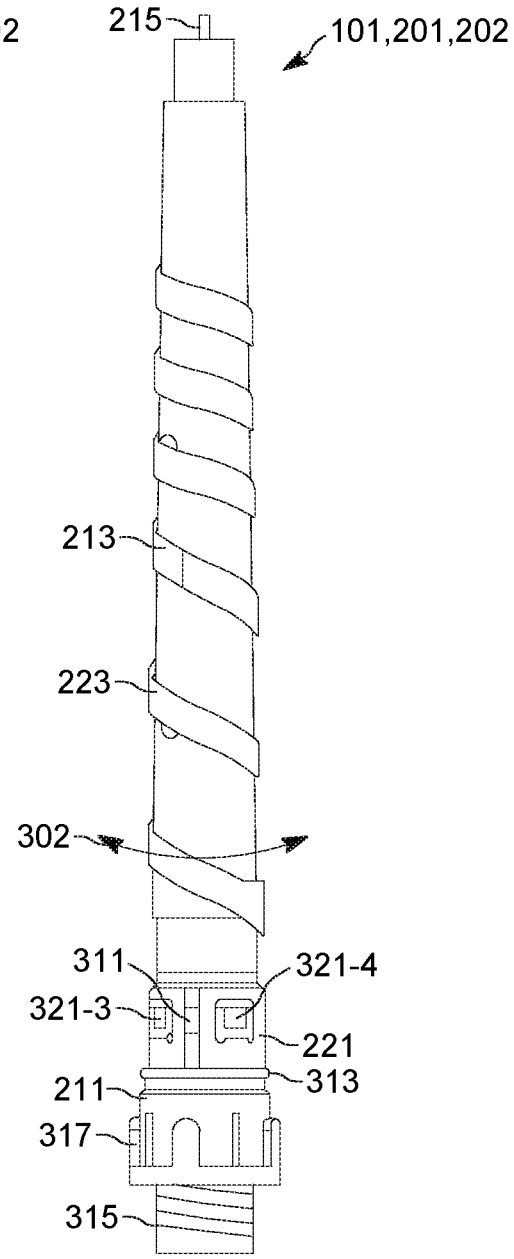
FIG. 3B is an opposite side view of the antenna device with the sheath removed, in accordance with some examples.
Figure 4B:
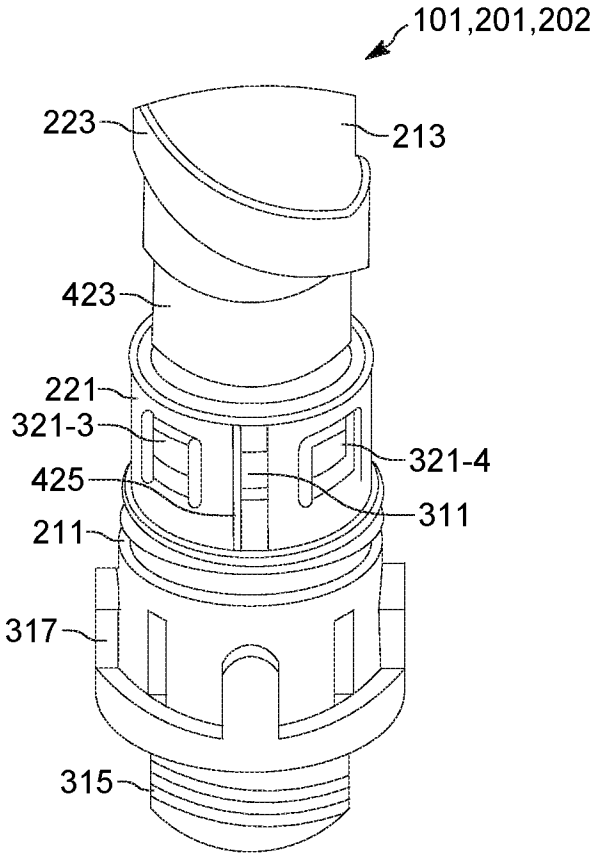
FIG. 4B is an opposite side view of the antenna device with the sheath removed, showing detail of the connection of the clip and the antenna element, in accordance with some examples.
Figure 4A:
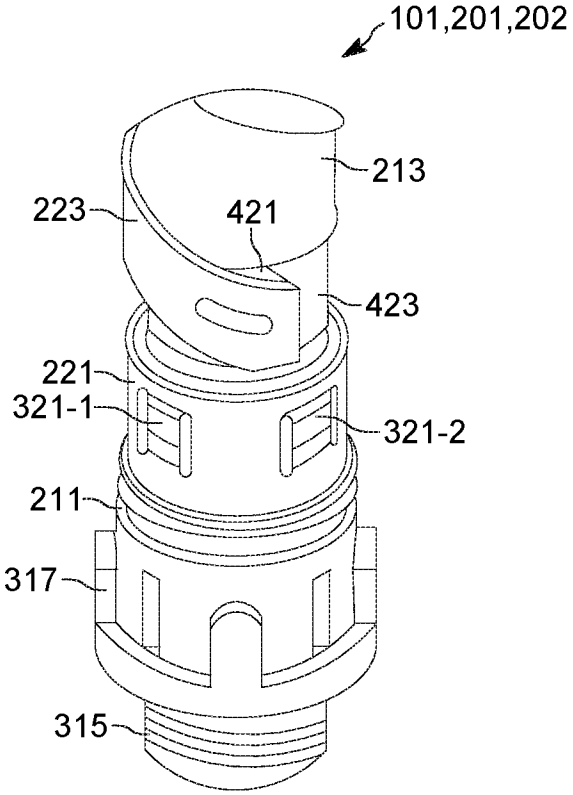
FIG. 4A is a side view of the antenna device with the sheath removed, showing detail of a connection of a clip and an antenna element, in accordance with some examples.

Attention is next directed to FIG. 3A, FIG. 3B, FIG. 4A and FIG. 4B. FIG. 3A and FIG. 3B depicts the units 201, 202 as assembled and/or the antenna device 101 without the sheath 231. FIG. 4A and FIG. 4B depicts details of the clip 221 as attached to the base 211, as well as the antenna element 223 as attached to the clip 221.

In particular, FIG. 3A and FIG. 4A each depict the antenna device 101 from a side that shows the antenna element 223 attached to the clip 221. FIG. 3B and FIG. 4B each depict the antenna device 101 from a side opposite that of FIG. 3A and FIG. 4A.

Both of FIG. 3A and FIG. 3B show that, when the units 201, 202 are assembled, the antenna element 223 generally extends from the clip 221 and further extends along, and/or wraps around, the insulating core 213.

As depicted, each of the base 211 and the clip 221 are cylindrical in shape, and the clip 221 may be configured to fully rotate around the base 211, as described hereafter. Similarly, the antenna element 223 is shaped to fully rotate around the insulating core 223 as the clip 221 fully rotates around the base 211. Such rotation is shown in FIG. 3A and FIG. 3B via arrows 301, 302, and may represent directions of torque on the antenna device 101 and/or tightening and/or loosening of the antenna device 101 as the antenna device 101 is attached to, and/or removed from, the device 100. While as depicted, the antenna element 223 is at least partially helical in shape, in other examples, the antenna element 223 may be at least partially straight in shape.

As best seen in FIG. 3B and FIG. 4B, to facilitate the rotation of the clip 221 around the base 211, the base 211 comprises a groove 311 at least partially therearound; indeed, as depicted, the groove 311 is fully around the base 211.

As depicted, the clip 221 comprises at least one biased retainer 321 (e.g. as depicted, a plurality of biased retainers 321-1, 321-2, 321-3, 321-4 spaced around the clip 221) retained in the groove 311, the at least one biased retainer 321 configured to slide along the groove 311 (e.g. in a circular motion) as the clip 221 at least partially rotates around the base 211 while making electrical contact thereto. As depicted, the at least one biased retainer 321 has a shape complementary to the groove 311; for example, as depicted, each of the at least one biased retainers 321 comprises a respective spring arm contact which reside in the groove 311 when the clip 221 is attached to the base 211.

As depicted, the base 211 may further comprise a step 313 against which a rim of the clip 221 rests as the base 211 retains the clip 221; in other words, when the clip 221 is slipped over the base 211, the biased retainers 321 clip into the groove 311, and the clip 221 is further held in position by a rim of the clip 221 residing against the step 313. The rim of the clip 221 also rotates against the step 313 when the clip 221 generally rotates around the base 211.

FIG. 3A, FIG. 3B, FIG. 4A and FIG. 4B depict yet further details of the base 211. In particular, the base 211 is configured to removably attach to a corresponding receptable at a communication device, for example the antenna receptable 103 at the device 100. To facilitate such attachment, as depicted, the base 211 may comprise threads 315 configured to attach to complementary threads at the antenna receptable 103, and the like. Indeed, the twisting motion used to attach or detach the base 211 to the antenna receptable 103 using the threads 315 may cause the stress on the antenna device 101 which may be at least partially relieved by the clip 221 being at least partially rotatable around the base 211, and the antenna element 223 being at least partially rotatable around the insulating core 213 as the clip 221 rotates at least partially around the base 211.

Also depicted in FIG. 3A, FIG. 3B, FIG. 4A and FIG. 4B are ridges 317 at the base 211 which may mate with complementary channels (not depicted), and the like, internal to the sheath 231, for example to facilitate attachment of the sheath 231 onto the base 211, for example when the unit 203 is slipped over the units 201, 202 as assembled. In some examples, the complementary channels internal to the sheath 231 may mechanically snap onto the ridges 317 to retain the sheath 231 and facilitate assembly of the units 201, 202, 203. In other examples, any suitable adhesive may be used to attach the complementary channels internal to the sheath 231 to the ridges 317. Regardless, sheath 231 is generally in a fixed position relative to the other components of the antenna device 101, and the ridges 317 may assist in holding the sheath 231 is such a fixed position.

Attention is next directed to FIG. 4A and FIG. 4B which depicts further details of the antenna element 223 interacting with the clip 221 and the insulating core 213. For example, FIG. 4A shows that, in some examples, the clip 221 may further comprise an antenna attachment portion 421 extending therefrom along the insulating core 213 and, as depicted, the antenna element 223 is attached to the antenna attachment portion 421. For example, the antenna attachment portion 421 may comprise a tab, and the like, extending from the clip 221, and integrated with the clip 221; as depicted the antenna element 223 is attached to such a tab.

Furthermore, as depicted, the insulating core 213 comprises a respective groove 423 extending cylindrically around the insulating core 213. As depicted, the antenna attachment portion 421 has a shape complementary to the groove 423 and is configured to rotate around the groove 423 as the clip 221 rotates around the base 211.

The antenna element 223 may be attached to the clip 221 using any suitable configuration and/or process. For example, the antenna element 223 and the clip 221 may be integrated (e.g. made from the same material). However, the antenna element 223 and the clip 221 may be manufactured using different processes and/or be made from different materials, and providing the antenna element 223 and the clip 221 as an integrated unit (e.g. made from the same material) may, in some examples, be challenging. In such examples, the antenna element 223 and the clip 221 may be manufactured separately (e.g. from different materials) and the antenna element 223 may be attached to the clip 221 via a solder joint and/or spot welding, and the like.

For example, the clip 221 may comprise electrically conducting spring steel and the antenna element 223 may comprise copper foil and/or the antenna element 223 may comprise a flex antenna element.

Indeed, as also seen in FIG. 4B, the clip 221 may not extend all the way around the base 211; rather, the clip 221 may include a gap 425 that may enable the clip 221 to at least partially expand as the clip 221 is being slipped over the base 211 to attach thereto. Hence, the clip 221 may comprise spring steel and/or be flexible such that the clip 221 at least partially expands via the gap 425 to as the clip 221 is being slipped over the base 211 to attach thereto.

Hence, as the clip 221 may comprise spring steel, and the like, and as the antenna element 223 may comprise copper foil and/or a flex antenna element, and ht like, the clip 221 and the antenna element 223 may generally be manufactured separately, using different processes, and attached to each other via the antenna attachment portion 421 (e.g. via a solder joint and/or spot welding) to form the unit 202.

Figure 5:
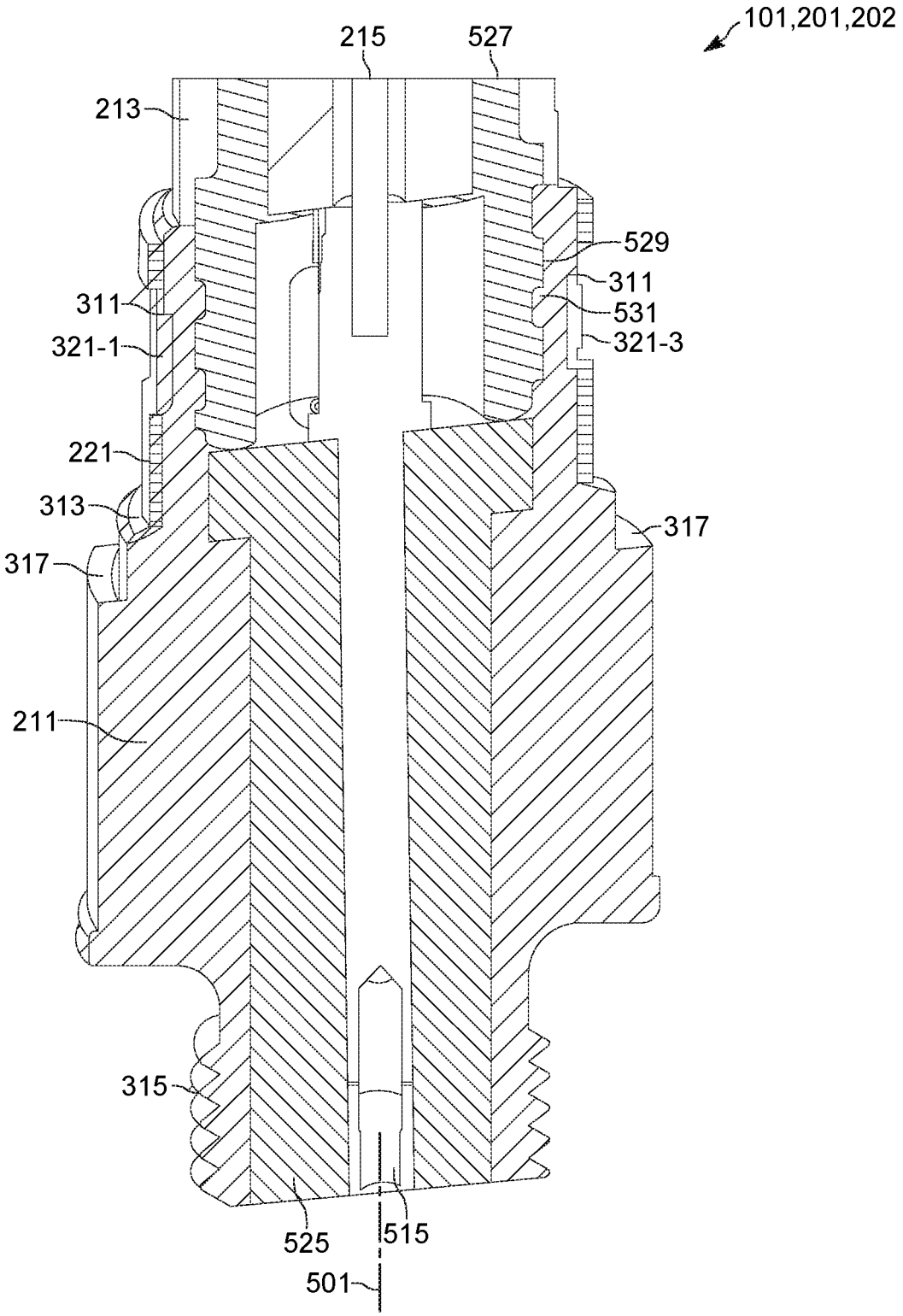
FIG. 5 is a cross-section of the antenna device with the sheath removed, showing detail of the connection of the clip and the antenna element, in accordance with some examples.

Attention is next directed to FIG. 5 which depicts a cross-section of the units 201, 202, as assembled, the depicted cross-section being perpendicular to a longitudinal axis 501 thereof.

In particular, from FIG. 5, it is understood that the internal antenna element 215 may comprise a monopole antenna which extends long the longitudinal axis 501 internal to the insulating core 213. From FIG. 5 it is further understood that at least a portion of the base 211, including the threads 315, the groove 311, the step 313, and the portion of the base 211 around which the clip 221 rotates, may be provided as an integrated conducting unit comprising, for example, any suitable metal, such as stainless steel, and the like, which electrically connects the base 211 to the transceiver 105 at the device 100, and hence further connects the antenna element 223 to the transceiver 105.

However, as depicted, the antenna device 101 further comprises an electrical connector 515 configured to electrically connect the internal antenna element 215 to the transceiver 105 at the device 100 when the base 211 is removably attached to the receptable 103 at the device 100. The electrical connector 515 is electrically separated from the base 211 via an insulating material 525 internal to the antenna device 101, and which may be a component of the unit 201. Hence, the internal antenna element 215 and the antenna element 223 may each be in communication with the transceiver 105 at the device 100 when the base 211 is removably attached to the receptable 103 at the device 100, respectively via the electrical connector 515 and the base 211. The internal antenna element 215 and the antenna element 223 may each be configured for operation in different frequency bands.

As also depicted in FIG. 5, the insulating core 213 may comprise further internal insulating material 527 which includes one or more cylindrical ridges 529 that mate with complementary internal cylindrical ridges 531 of the base 211 to assist with attachment of the insulating core 213 to the base 211 to form the unit 201. Adhesive, and the like, may be used to attach the ridges 529, 531.

FIG. 5 also shows a cross-sectional shape of the at least biased retainer 321 (e.g. the biased retainers 321-1, 321-3) as being complementary to the cross-sectional shape of the groove 311. Hence, the biased retainers 321 snap into the groove 311 when the clip 221 mates with the base 211.

In the foregoing specification, specific embodiments have been described. However, one of ordinary skill in the art appreciates that various modifications and changes may be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

In this document, language of "at least one of X, Y, and Z" and "one or more of X, Y and Z" may be construed as X only, Y only, Z only, or any combination of two or more items X, Y, and Z (e.g., XYZ, XY, YZ, XZ, and the like). Similar logic may be applied for two or more items in any occurrence of "at least one . . . " and "one or more . . . " language.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment may be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it may be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

We claim:

1. An antenna device comprising:

a base, the base being electrically conducting;

an insulating core extending from the base;

a clip attached to the base, the clip being electrically conducting, the clip and the base configured to cooperate such that: the base frictionally retains the clip; and the clip fully rotates around the base, after the clip is attached to the base, while maintaining a longitudinal position along a longitudinal axis relative to the base when rotating, and while making electrical contact thereto; and an antenna element extending from the clip along the insulating core, the antenna element shaped to fully rotate around the insulating core as the clip fully rotates around the base, after the clip is attached to the base.

2. The antenna device of claim 1, wherein the base comprises a groove therearound, and the clip comprises at least one biased retainer retained in the groove, the at least one biased retainer configured to slide along the groove as the clip fully rotates around the base while making electrical contact thereto.

3. The antenna device of claim 2, wherein the at least one biased retainer has a shape complementary to the groove.

4. The antenna device of claim 2, wherein the at least one biased retainer comprises a spring arm contact.

5. The antenna device of claim 2, further comprising a plurality of biased retainers, including the at least one biased retainer, the plurality of biased retainers spaced around the clip.

6. The antenna device of claim 1, wherein each of the base and the clip are cylindrical in shape.

7. The antenna device of claim 1, wherein the clip is configured to slide over the insulating core to attach the clip to the base.

8. The antenna device of claim 1, wherein the base comprises a step against which a rim of the clip rests as the base retains the clip.

9. The antenna device of claim 1, wherein the antenna element is at least partially helical in shape.

10. The antenna device of claim 1, wherein the antenna element is at least partially straight in shape.

11. The antenna device of claim 1, wherein the clip comprises an antenna attachment portion extending therefrom along the insulating core, and the antenna element is attached to the antenna attachment portion.

12. The antenna device of claim 1, wherein the antenna element is attached to the clip via a solder joint.

13. The antenna element of claim 1, wherein the antenna element and the clip are integrated.

14. The antenna element of claim 1, wherein the antenna element comprises copper foil.

15. The antenna element of claim 1, wherein the antenna element comprises a flex antenna element.

16. The antenna device of claim 1, wherein the base is further configured to:

removably attach to a corresponding receptable at a communication device; and electrically connect to a transceiver at the communication device.

17. The antenna device of claim 16, wherein the base comprises threads configured to attach to complementary threads at the corresponding receptable.

18. The antenna device of claim 1, further comprising:

an internal antenna element located inside the insulating core, the internal antenna element electrically isolated from the antenna element, the clip and the base; and an electrical connector configured to electrically connect the internal antenna element to a transceiver at a communication device when the base is removably attached to a corresponding receptable at the communication device.

19. The antenna device of claim 1, further comprising a sheath containing the clip, the insulating core, the antenna element, and at least a portion of the base that retains the clip.

20. A portable communication device comprising:

a housing; a transceiver; an antenna receptable; and antenna device comprising:

a base, the base being electrically conducting, the base configured to removably attach to the antenna receptable;

an insulating core extending from the base;

a clip attached to the base, the clip being electrically conducting, the clip and the base configured to cooperate such that: the base frictionally retains the clip; and the clip at fully rotates around the base, after the clip is attached to the base, while maintaining a longitudinal position along a longitudinal axis relative to the base when rotating, and while making electrical contact thereto; and an antenna element extending from the clip along the insulating core, the antenna element shaped to fully rotate around the insulating core as the clip fully rotates at around the base, after the clip is attached to the base, the transceiver in communication with the antenna element via the antenna receptable and the base to wirelessly communicate via the antenna element.

21. An antenna device comprising:

a base, the base being electrically conducting;

an insulating core extending from the base;

a clip attached to the base, the clip being electrically conducting, the clip and the base configured to cooperate such that: the base frictionally retains the clip; and the clip at least partially rotates around the base while making electrical contact thereto; and an antenna element extending from the clip along the insulating core, the antenna element shaped to at least partially rotate around the insulating core as the clip rotates at least partially around the base, wherein the base comprises a groove at least partially therearound, and the clip comprises a spring arm contact retained in the groove, the spring arm contact configured to slide along the groove as the clip at least partially rotates around the base while making electrical contact thereto.

* * * * *